United States Patent [19]

Gildehaus

[11] Patent Number: 4,827,682

[45] Date of Patent: May 9, 1989

[54] GARDEN WINDOW FRAME ASSEMBLY

[76] Inventor: Paul E. Gildehaus, #2 Treebrook, Ladue, Mo. 63124

[21] Appl. No.: 172,451

[22] Filed: Mar. 24, 1988

[51] Int. Cl.[4] ..... E06B 1/04

[52] U.S. Cl. ..... 52/201; 52/202; 52/217

[58] Field of Search ..... 52/217, 202, 201, 213; 49/505

[56] References Cited

U.S. PATENT DOCUMENTS

| | | | |
|---|---|---|---|
| 400,605 | 4/1889 | Scholfield | 52/201 |
| 2,962,133 | 11/1960 | Kivett et al. | 411/437 X |
| 3,553,891 | 1/1971 | Casebolt et al. | 52/217 X |
| 3,583,114 | 6/1971 | Belfor | 49/505 X |
| 3,585,770 | 6/1971 | Maizler | 52/217 |
| 4,038,791 | 8/1977 | Atkinson | 52/73 X |
| 4,453,346 | 6/1984 | Powell et al. | 52/217 X |

*Primary Examiner*—Carl D. Friedman

*Attorney, Agent, or Firm*—Rogers, Howell, Moore & Haferkamp

[57] ABSTRACT

A frame for mounting devices such as garden windows into the ordinary window frame of a building. It includes so-called outer channel members that preferably can surround the garden window and to which the garden window can be secured and inner channel members that are disposed within the outer channel members and are held therein fixedly by screws that adjust their spacing inwardly and outwardly with respect to the outer channel members so that they can accommodate variations in the size, warp, out of square, and the like of the window frames, and also so that they can hold foam material or the like that can seal around the frame to prevent air from passing around the frame into the building.

21 Claims, 2 Drawing Sheets

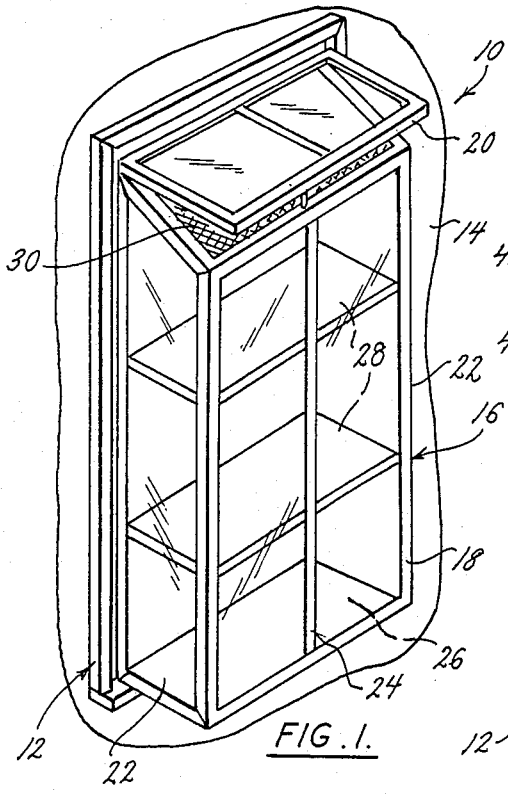
FIG. 1.
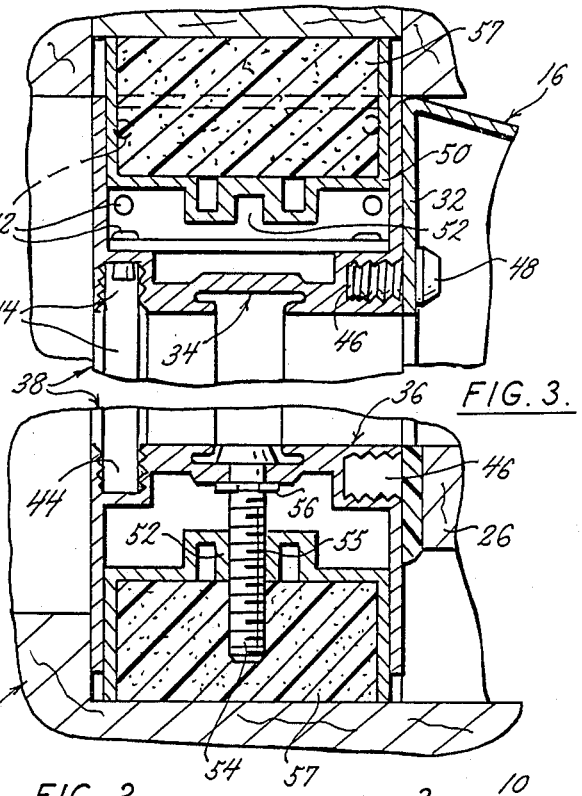
FIG. 3.
FIG. 2.
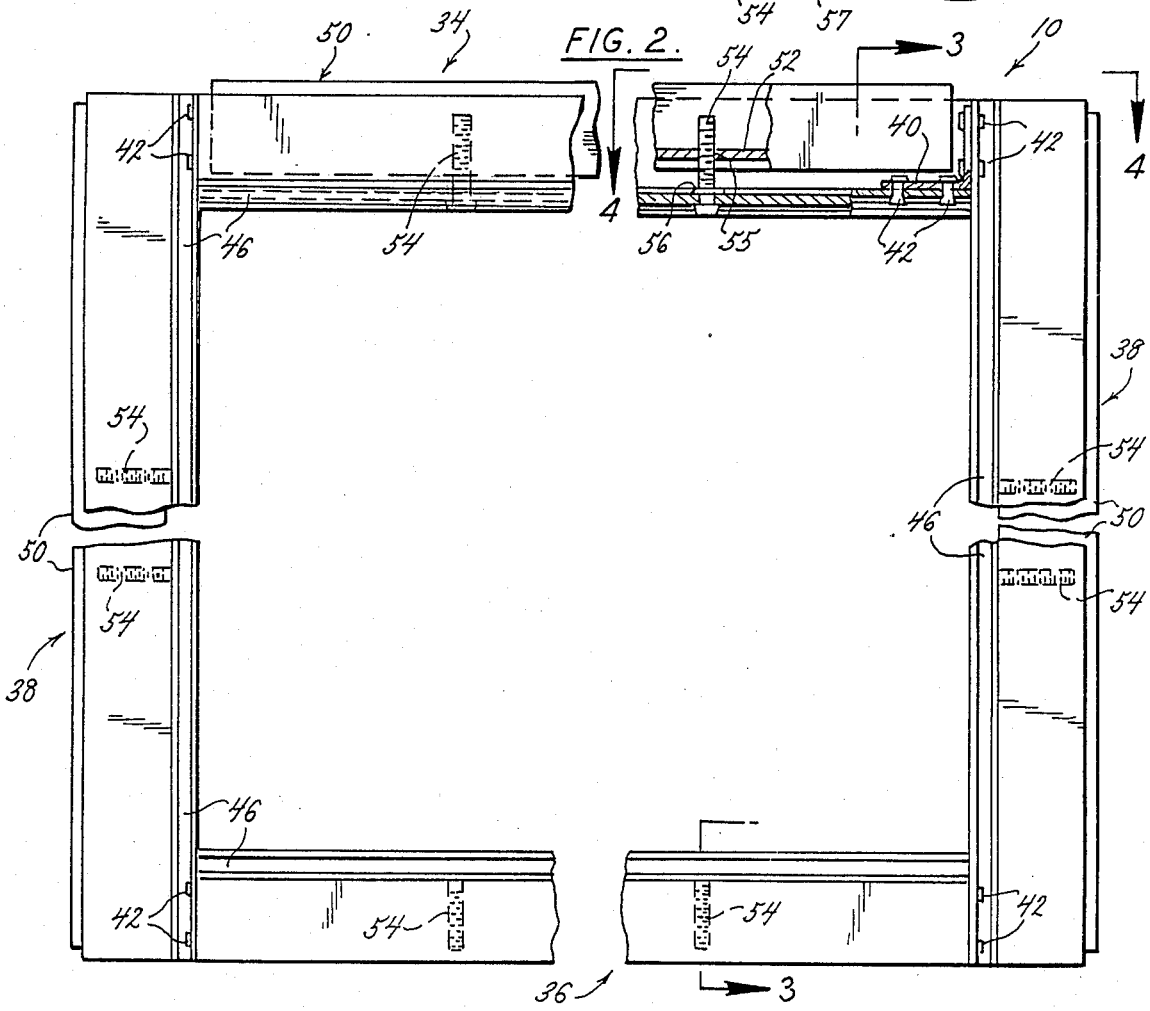

GARDEN WINDOW FRAME ASSEMBLY

BACKGROUND AND SUMMARY OF THE INVENTION

This invention relates to a garden window frame assembly adapted for installing and attaching a garden window to an existing window frame in a window opening of a building.

Many types of garden windows have been installed in existing window openings of residences and other buildings. Examples of garden windows and methods for installing them are disclosed in U.S. Pat. Nos. 1,152,899; 1,214,057; 2,074,872; 3,148,479; 4,038,791; and 4,009,546.

Typically garden windows are installed by either extensively altering the existing window frame and attaching the garden window to the altered frame or by attaching the garden window directly to the existing window frame. Attaching the garden window usually consists of driving nails through a flange in the garden window into the window frame. Both methods of installation result in the garden window being permanently attached to the window frame.

Alteration of the window frame or installation of the garden window may require the services of a skilled carpenter using special tools. Indeed, some garden windows are very complex and require many hours of work to properly install them. Also, if it is ever desired to remove the garden window, the existing frame will require repair. Thus, the addition or removal of a garden window may not be a job a do-it-yourselfer would want to undertake.

Additionally, windows are not produced in standardized sizes. In fact, a house may have some windows of one size and other windows of a different size. If the home owner desired to install two garden windows the owner might be faced with the problem of purchasing two differently sized garden windows. The garden window manufacturer must produce many different sized windows. Therefore, it would be advantageous to manufacture a standard sized garden window which could be installed in window openings of various sizes.

In accordance with the present invention, there is provided a garden window frame assembly for installing and attaching a garden window to an existing window frame. The garden window frame assembly generally comprises a head section, a sill section, and a pair of jamb sections connected together to form a rectangular shaped frame. The sections are connected together by using L-shaped flanges which are fastened to the ends of the sections. Rivets may be used to fasten the flanges to the sections. Inserted in each of the sections is a movable inner member which can be adjusted relative to the sections to engage the existing window frame. Fastening means, such as Allen head screws, are threaded through holes in the sections and members and a retaining clip is mounted on each screw in the area defined between each of the sections and members. Exterior screw channels are formed in each of the sections. The garden window is attached to the frame assembly by inserting screws through a flange in the garden window into the exterior screw channels.

To install the frame assembly the windows are removed from the window frame and the assembly is mounted in the window frame to position its head section below the head of the window frame, the jamb sections aligned with the jambs of the window frame, and the sill section is mounted on the windowsill. Once the frame assembly is properly positioned the inner members are adjusted to engage the window frame. Adjusting the inner members is accomplished by loosening or tightening the Allen head screws to move the inner members relative to the sections. Although the frame assembly may be installed first and the garden window attached to the assembly, it is preferred to install the frame assembly and the garden window as a unit.

In some situations it may be difficult to remove the windows from the window frame without damaging the frame. Some double hung windows have one stationary window and one movable window. The movable window has a weight mechanism which holds it in the up position once it is moved. The stationary window is typically in the up position. In order to remove the movable window from the frame, the mechanism needs to be cut and parts of the frame removed. In this situation a modified version of the frame assembly is employed. The modified frame assembly resembles the previously described frame assembly except the head section and its inner member are replaced with a head section having an L-shaped cross-section. To install this modified version, the movable window is placed in the up position and the modified assembly is mounted in the window frame. The head section is positioned to abut the lower end of the stationary window and the inner members are adjusted to secure the frame assembly in place. As stated above, the garden window may either be attached to the assembly prior to or after installation of the frame assembly.

These and other advantages of the invention are apparent from the detailed description to follow.

DESCRIPTION OF THE DRAWINGS

FIG. 1 is a perspective view of a garden window mounted on a garden winfow frame assembly of the present invention;

FIG. 2 is a front sectional view of the garden window frame assembly of the present invention;

FIG. 3 is an enlarged partial cross-sectional view taken along the line 3—3 of FIG. 2;

DETAILED DESCRIPTION OF THE PREFERRED EMBODIMENT

Figure 4:
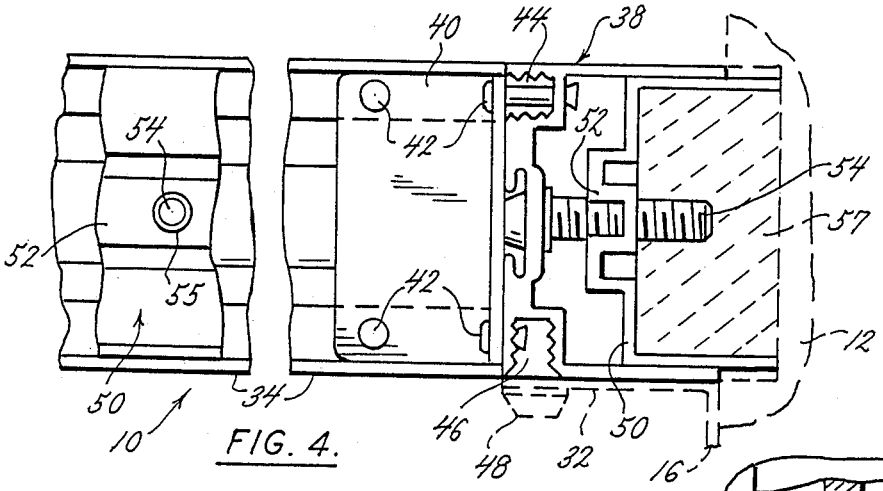
FIG. 4 is an enlarged partial cross-sectional view taken along the line 4—4 of FIG. 2.

Referring to the drawings, FIG. 1 illustrates a garden window frame assembly 10 installed in an existing window frame 12 in an outside wall 14 of a building with a garden window 16 attached to the assembly 10.

The garden window 16 which is illustrated in FIG. 1 is generally of rectangular shape having component parts which form a rigid frame structure 18. The frame structure 18 consists of a movable top section 20, a pair of side sections 22, a front section 24, and a bottom section 26. Adjustable shelves 28 may also be included as part of the garden window 16. An insect screen 30 is also provided to stop insects from entering the garden window 16 when the top section 20 is opened. A flange 32 extends from the garden window 16 and is used to attach the window 16 to the frame assembly 10.

The frame assembly 10 is shown in greater detail in FIGS. 2, 3, and 4 and is constructed using individual outer sections and inner members. The sections and members may be made from any suitable extruded material such as aluminum or vinyl.

The outer sections of the assembly consist of a head section 34, sill section 36, and a pair of jamb sections 38. The outer sections are connected together to form a rectangular shaped frame by connecting the top ends of the pair of jamb sections 38 to the ends of the head section 34 and connecting the bottom ends of the pair of jamb sections 38 to the ends of the sill section 36. The frame may also be configured to other shapes. L-shaped brackets 40 are used to connect the sections together and rivets 42 attached the brackets 40 to the sections as is best shown in FIGS. 2 and 4.

Each outer section is generally U-shaped in cross-section as is illustrated in FIGS. 3 and 4. An interior striated screw channel 44 and an exterior screw striated channel 46 are formed in the outer sections. The screw channels 46 receive screws 48 which fasten the garden window 16 to the frame assembly 10. The interior screw channel 44 also serves as an area which receives some of the rivets 42 "The channel 44 does not have other functions in the present construction."

Positioned within each of the outer sections is a movable inner channel member 50. The movable member 50 is an extended generally U-shaped in cross-section. At the middle of the movable member is a screw channel 52 which can best be seen in FIGS. 3 and 4. Fastening means such as Allen head screws 54 are inserted through holes 55 in the member 50 and the outer section and hold each movable member 50 within each of the outer sections. A retaining clip 56 is mounted on each of the screws 54 between the movable member 50 and the outer section. With the clips 56 mounted on the screws 54, rotation of the screws 54 moves the inner member 50 relative to the outer section. Movement of screws 54 in the counterclockwise direction will move the inner member 50 away from the outer section, while rotation of the screws 54 in the clockwise direction moves the inner member 50 toward the outer section. A section of foam rubber or other foam material 57 (shown in FIG. 4) may be placed in each inner member to create an air tight seal and to insulate the frame assembly 10.

In order to install and attach the frame assembly 10 in an existing window opening, the windows need to be removed from the window frame. Once they are removed, the assembly 10 is placed in the window opening with the assembly 10 oriented so that the head section 34 is below the head of the window frame 12, the sill section 36 is seated on the windowsill, and the jamb sections 38 are aligned with the corresponding jambs of the existing window frame 12. Attached to the jamb sections 38 are removable flanges (not shown) which extend beyond the frame assembly 10 and engage the interior of the existing window frame 12 to secure the frame assembly 10 during the installation procedure. Although the flanges are removable they may remain on the frame assembly 10 to further secure the assembly 10. After having oriented the frame assembly properly, the inner members 50 need to be adjusted to selectively engage the existing window frame 12 to secure the frame assembly 10 in place. To adjust the inner members 50 the screws 54 are tightened or loosened as the case may be to secure the inner members 50 against the window frame 12. To remove the frame assembly 10 and garden window 16, the steps for installation are reversed.

It should be noted that the garden window 16 and the frame assembly 10 are typically attached together prior to installation. However, it is also possible to install the frame assembly 10 and then attach the garden window 16.

Figure 5:
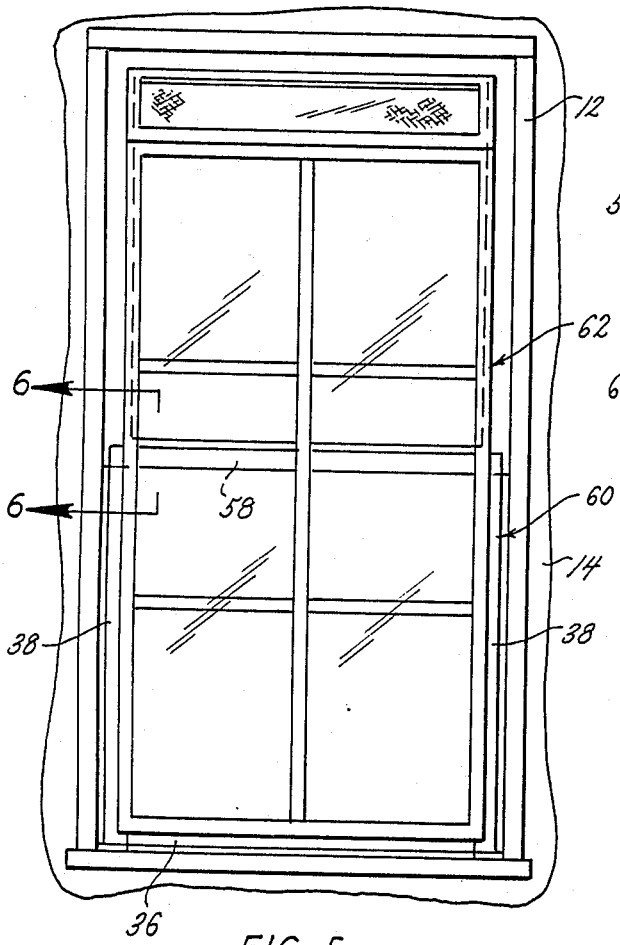
FIG. 5 is a front perspective view of a garden window mounted on a second embodiment of the garden window frame assembly of the present invention.
Figure 6:
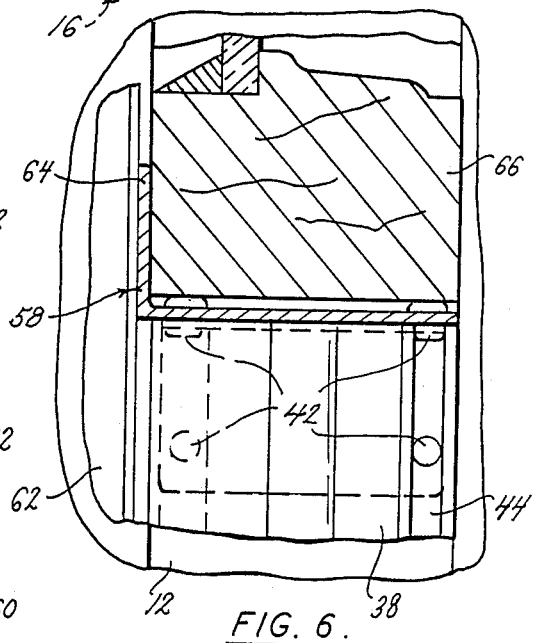
FIG. 6 is an enlarged partial cross-sectional view taken along the line 6—6 of FIG. 5.
Figure 7:
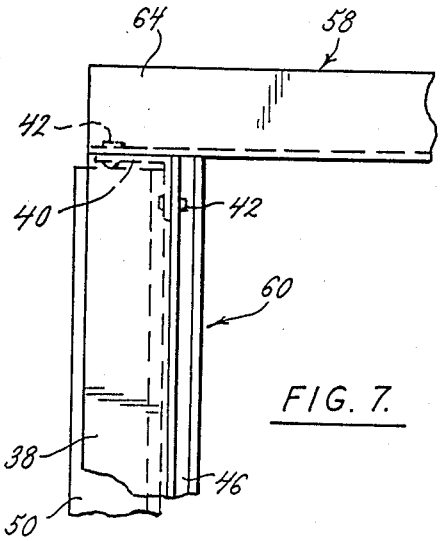
FIG. 7 is an enlarged partial sectional view of the upper left hand corner of the frame assembly shown in FIG. 5 with the garden window removed.

An alternate embodiment of the present invention is shown in FIGS. 5–7, with the principal difference being that an L-shaped head section 58 has been substituted in place of the outer head section 34 and its movable inner member 50 of the frame assembly 60, and is installed in a window opening in which the windows have not been removed. In some double hung windows it is impractical to remove the windows because the sills would have to be damaged. When this is the case this alternate frame assembly 60 is used.

Installation of the frame assembly 60 is accomplished in much the same manner as previously described except for the following modifications. Both windows are placed in the up position and the garden window 62 and the frame assembly 60 are then inserted through the window opening. The frame assembly 60 is oriented to align the jamb sections 38 with the corresponding jambs of the existing window frame, set the sill section 36 on the window sill, and position the exterior section 64 of the L-shaped head section 58 with the bottom of the outermost window 66. Once oriented, the inner members 50 are adjusted to lock the frame assembly 60 in place.

There are notable advantages in the structure herein described, particularly with respect to the use of the channel sections. In the first place, the channel sections provide adjustability to accommodate window frames of different sizes. Then further, the channel cross-section of a structure of this kind lends substantially maximum anti-bending strength. Also, the presentation of the edges of the channel section to the window frame, rather than having solid bars, helps to overcome any irregularities in the window frame, particularly because the window is out of square, and permits a tighter engagement between the present frame and the window itself. Most particularly, the structure shown can enable fitting of the frame into windows that have warped, or have become misaligned.

Also, the structure is suited to the use of foam plastic inserts between the inner and outer channel members as well as within the inner channel member and the window frame to minimize leakage of air around the present invention. The foam plastic strips can be very greatly compressed and can be suitable for different adjustments of the inner and outer frame members of the present device.

There are various changes and modifications which may be made to the invention as may be apparent to those skilled in the art. However, these changes or modifications are included in the teaching of the disclosure, and it is intended that the invention be limited only by the scope of the claims appended hereto.

What is claimed is:

1. In a holding frame for supporting devices such as a garden window within a fixed frame, the holding frame comprising holding frame members extending on opposite sides of the holding frame and firmly secured together to be expandable in the fixed frame and to be secured therein, the holding frame on at least one side having an adjustable member supported by the holding frame for expanding movement therefrom outwardly toward the fixed frame and back, setting means in the holding frame to adjust the holding frame member toward and from the fixed frame to expand the frame outwardly against the fixed frame, to force the opposite sides of the holding frame members against the fixed frame the setting means being adapted to hold the same in secured position against the fixed frame.

2. In the holding frame of claim 1 having opposite sides to align with the opposite sides of the fixed frame and like members engageable with the fixed frame and supported on the opposite sides of the holding frame and like setting means to adjust the said members toward and from the fixed frame to expand the holding frame and to engage the fixed frame and thereby and to hold it securely in engagement therewith.

3. An assembly for installing and attaching a garden window or the like to an existing fixed frame comprising:

a head section;

a sill section;

a pair of jamb sections;

means for connecting the sections to form a rectangular shaped frame;

a movable inner member inserted into each of the sections;

setting means for expanding the inner members outwardly relative to each of the sections for engagement of the inner members against the existing fixed frame, to hold the sections within the fixed frame; and means for attaching the garden windowlike member to the assembly.

4. The assembly of claim 3 wherein each of the sections has an exterior screw channel which extends along the length of each section to receive the setting means for securing the windowlike member thereto.

5. The assembly of claim 3 wherein each of the sections further has an interior channel which extends along the length of each section.

6. The assembly of claim 3 wherein the sections are generally U-shaped, opening outwardly.

7. The assembly of claim 3 wherein the inner members are generally U-shaped channels, opening outwardly, and of a size to substantially fill and slidably engage within the outer members.

8. The assembly of claims 1, 3 or 7 wherein the setting means comprises means to adjust the inner members relative to the outer members to accommodate irregularities and misalignments of the fixed frame.

9. The assembly of claim 3 wherein the connecting means comprises a plurality of L-shaped flanges.

10. The assembly of claim 9 wherein the connecting means further comprises fastening means for attaching the flanges to the sections.

11. The assembly of claim 3 wherein the expanding means comprises a screw threaded through each of the sections and the members, and a retaining clip mounted on the screw between the sections and the members.

12. The assembly of claim 3 wherein the attaching means comprises a plurality of screws which are threaded through the garden window into the exterior screw channels.

13. The assembly of claim 12 wherein each setting means comprises at least one screw passing through each of the sections and threaded into the inner members, and a retaining clip mounted on the screw between the sections and the members.

14. A garden window frame assembly for installing and attaching a garden window to an existing window frame comprising:

a head section;

a sill section;

a pair of jamb sections;

means for connecting the sections to form a rectangular shaped frame;

a movable inner member inserted into each of the sill section and the pair of jamb sections;

setting means for expanding the inner members outwardly relative to the sill section and the pair of jamb sections for engagement of the inner members against the existing window frame, the setting means being adapted to hold force against the inner members thereby to hold the sections within the window frame; and means for attaching the garden window to the assembly.

15. The assembly of claim 14 wherein the head section is L-shaped in cross-section.

16. The assembly of claim 14 wherein each of the sill and jamb sections has an exterior screw channel which extends along the length of each section to receive the setting means for holding the members into the frame.

17. The assembly of claim 14 wherein each of the sill and jamb sections is generally U-shaped, opening outwardly.

Rewrite claim 17 as follows:

18. The assembly of claim 14 wherein each of the inner members is generally U-shaped, opening outwardly, and is slidingly received in its outer member.

19. The assembly of claim 14 wherein each of the inner members has a screw channel which extends along the length of each member.

20. The assembly of claim 14 wherein the connecting means comprises a plurality of L-shaped flanges which are fastened to the sections.

21. The assembly of claim 14 wherein the attaching means comprises a plurality of screws which are threaded through the garden window into the screw channels.

* * * * *